US009909394B1

(12) United States Patent
Hosie

(10) Patent No.: US 9,909,394 B1
(45) Date of Patent: Mar. 6, 2018

(54) DEVICE FOR GRIPPING AN OBJECT IN A CONSTRAINED SPACE

(71) Applicant: SUBSEA TECHNOLOGY, INC., Houston, TX (US)

(72) Inventor: David G. Hosie, Houston, TX (US)

(73) Assignee: Subsea Technology, Inc., Houston, TX (US)

( * ) Notice: Subject to any disclaimer, the term of this patent is extended or adjusted under 35 U.S.C. 154(b) by 406 days.

(21) Appl. No.: 14/718,035

(22) Filed: May 20, 2015

(51) Int. Cl.
*E21B 40/00* (2006.01)
*E21B 41/00* (2006.01)

(52) U.S. Cl.
CPC ..... *E21B 40/00* (2013.01); *E21B 41/0021* (2013.01)

(58) Field of Classification Search
CPC ..... E21B 33/06; E21B 29/08; E21B 29/04; E21B 41/0021; E21B 40/00; E21B 19/00
See application file for complete search history.

(56) References Cited

U.S. PATENT DOCUMENTS

| | | | | |
|---|---|---|---|---|
| 1,788,542 | A * | 1/1931 | Page | E21B 19/10 188/67 |
| 3,579,752 | A * | 5/1971 | Brown | E21B 19/10 188/67 |
| 5,575,451 | A * | 11/1996 | Colvin | E21B 33/062 251/1.1 |
| 6,053,252 | A * | 4/2000 | Edwards | E21B 19/22 166/338 |
| 6,543,546 | B2 * | 4/2003 | Kaiser | E21B 33/062 166/382 |
| 7,963,319 | B2 * | 6/2011 | Daigle | E21B 17/026 166/54.5 |
| 2004/0124380 | A1 * | 7/2004 | Van Winkle | E21B 33/06 251/1.3 |

* cited by examiner

*Primary Examiner* — Caroline N Butcher
(74) *Attorney, Agent, or Firm* — Buskop Law Group, P.C.; Wendy Buskop

(57) ABSTRACT

A gripper assembly for gripping coiled tubing with lower and upper ball carriers. A first gripper portion and a second gripper portion each have a channel for a bore through the gripper portions. Gripper portions can rotate in relation to each other. Rotation causes the gripper portion to close around an object that passes through the bore. With a translational force, the gripper portions rotate relative to each other to grasp an object.

14 Claims, 8 Drawing Sheets

DEVICE FOR GRIPPING AN OBJECT IN A CONSTRAINED SPACE

FIELD

The present embodiments generally relate to a device for remotely gripping objects in a constrained space.

BACKGROUND

Operations conducted in constrained spaces, such as downhole services often require the use of remotely placed tools or objects. Often these objects must be manipulated at a distance.

Coiled tubing, wireline, or other similar objects can be grasped or cut within a wellbore for operational or safety considerations.

Upon cutting coiled tubing, the present state of the art does not allow for an efficient means of preventing cut portions from falling into a wellbore. This can cause operational risks or complications.

The operational risks can include compromised well control and safety, expensive fishing operations, or even the loss of the well.

A need exists for a device that can be positioned in a wellbore or adjacent to a wellbore and can catch and suspend objects such as coiled tubing or wireline within a constrained space.

A further need exists for a device that can be designed to handle harsh environments, such as a device positioned and operated within the limited space inside a blowout preventer stack or wellbore.

The present embodiments meet these needs.

BRIEF DESCRIPTION OF THE DRAWINGS

The detailed description will be better understood in conjunction with the accompanying drawings as follows.

Figure 1A:
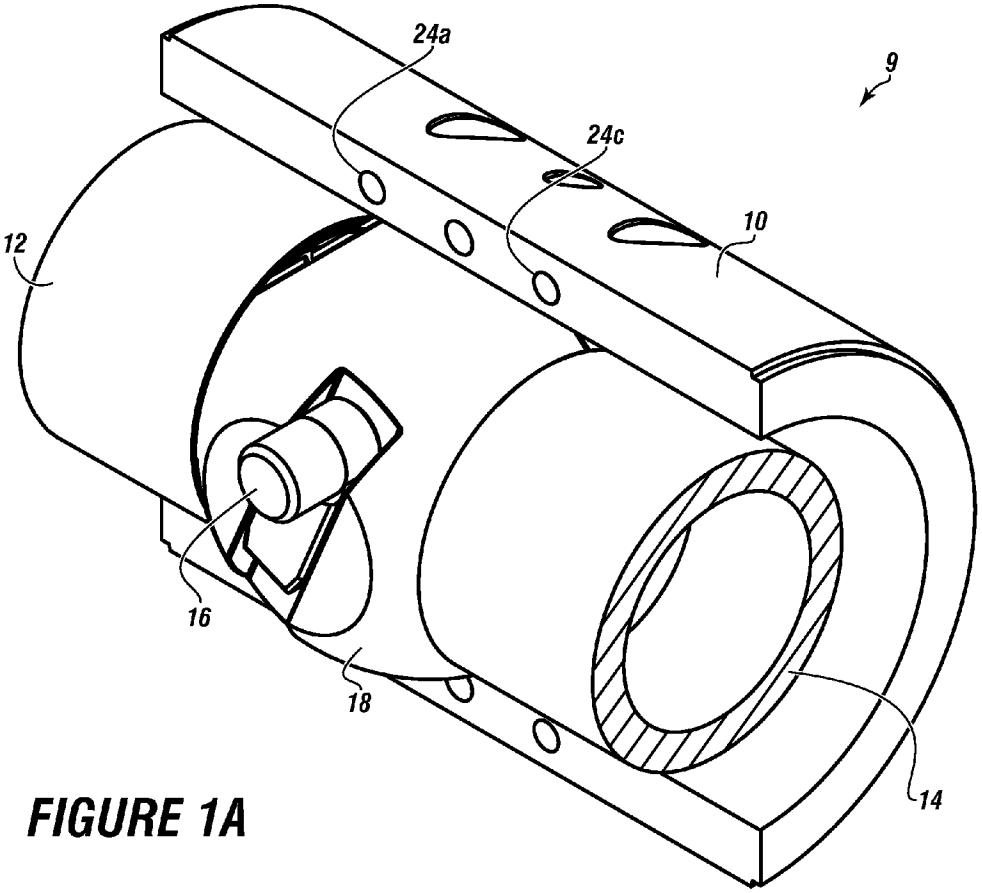
FIGS. 1A-IC depicts the gripper assembly in an open position according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

Specific structural and functional details disclosed herein are not to be interpreted as limiting, but merely as a basis of the claims and as a representative basis for teaching persons having ordinary skill in the art to variously employ the present invention.

The present embodiments generally relate to a device for remotely gripping objects in a constrained space.

A typical use for the present invention can be to catch coiled tubing or wireline if the coiled tubing is to be cut during an operation in a wellbore.

The present invention can have two members rotating in opposing relative directions to clamp to a portion of objects in a constrained space, such as coiled tubing or wireline in a wellbore, preventing the coiled tubing or wireline from dropping into the wellbore.

In offshore environments, such as operations conducted from a floating vessel, there can often be requirements to cut coiled tubing in emergency situations, such as a drive off. Drive offs occur when the dynamic positioning system of the semisubmersible or drill ship fails or when mooring chains break and coiled tubing needs to be cut.

Currently, the industry allows cut coiled tubing to simply drop in the well, which then requires an additional drilling operation or fishing operation to remove the coiled tubing to recreate a clean producing well. Sometimes, rams in blowout preventers can be used to catch coiled tubing. In other situations, slip arrangements with blowout preventers can be used to catch cut coiled tubing.

The present invention is a gripper assembly which can use a plurality of gripper portions, such as a first and a second gripper portion, which can be positioned proximate to each other and constrained to a relative orientation and position. The description below uses two gripper portions for the sake of clarity. However, persons having ordinary skill in the art will recognize that multiple gripper portions can be used.

While symmetrical gripper portions are described for the sake of clarity, the portions need not be mirror images, or even substantially the same shape. Persons having ordinary skill in the art will appreciate that the geometry of the constrained space of any given application will dictate the most efficient structures for the gripper portions. Gripper portions can be substantially spherical, cylindrical, conical, or portions thereof.

The means of constraining the gripper portions in a desired position and orientation can be any known means such as a housing, a sleeve, a frame, a guide arm, or even the geometry of the space in which the device is utilized can be used. For example, the walls of a constrained space, such as a wellbore, can be used to keep the gripper portions in a desired relative orientation.

The gripper portions can each have a channel which together defines a bore through the gripper assembly. The channels need not be symmetrical or of identical shape or depth. The bore can allow an object to pass through the gripper portions or be constricted to grasp the object.

In embodiments, two gripper portions can interface with each other to grasp and suspend an object. A first gripper portion can rotate in relation to a second gripper portion. The gripper portions need only rotate relative to each other. Therefore, this can be accomplished by rotating one or both of the gripper portions.

In rotating, the channels formed in the gripper portions can constrict the bore to grasp an object. The channels, which can be integral parts of the gripper portions can hold objects in the constricted bore.

The means of rotating the gripper portions can be a translational force provided by any means known to persons having ordinary skill in the art. Non limiting examples of such means are a hydraulic piston, a pneumatic piston, an electromagnetic device, an explosive bolt, a propellant, and the like.

The present invention can grasp objects within a constrained space, such as coiled tubing, between the gripper portions. In subsea operations, the invention can catch coiled tubing cut in an emergency situation thus preventing it from falling into a well.

In embodiments, translational force such as from a piston can be used on one side of the gripper portions to provide translational motion to the gripper portions in a sleeve. The translational motion can move the gripper portions and ball carriers within the sleeve in a single direction.

In embodiments, the translational force can be applied by a piston that can be hydraulic or pneumatic. The translational force providing device can be electromagnetic, explosive bolts, or a propellant, such as an ignited gas.

In embodiments the gripper portions together can substantially have a shape of a sphere with a 4 inch to 8 inch diameter.

In embodiments, the channels in the gripper portions can form a 3 inch diameter bore.

In embodiments, the bore of the gripper portions can be designed to support the full flow of drilling fluid from a well.

In embodiments, the gripper portions can be formed from a material that can sustain the 20,000+ psi of drilling fluid that flows through the bore of the gripper portions without deforming.

Turning now to the Figures, FIGS. 1A-IC depict a gripper assembly in an open position according to one or more embodiments.

FIG. 1A depicts a gripper assembly 9 in an open position.

The gripper assembly 9 can have the means of constraining the first gripper portion and the second gripper portion can be a lower ball carrier 12 and an upper ball carrier 14 which can contain a first gripper portion 18 between them. A means of rotating the first gripper portion 18, the second gripper portion, or both the first gripper portion 18 and the second gripper portion is shown as an operator arm 16 connected to the first gripper portion 18.

In this embodiment, surrounding the first gripper portion 18 and between the lower ball carrier and the upper ball carrier is one half of a sleeve. A first half sleeve 10 is shown with fastener holes 24*a*-24*c* which can be used to contain fasteners that can tighten the first half sleeve to a second half sleeve around the gripper portions and the ball carriers.

Figure 1C:
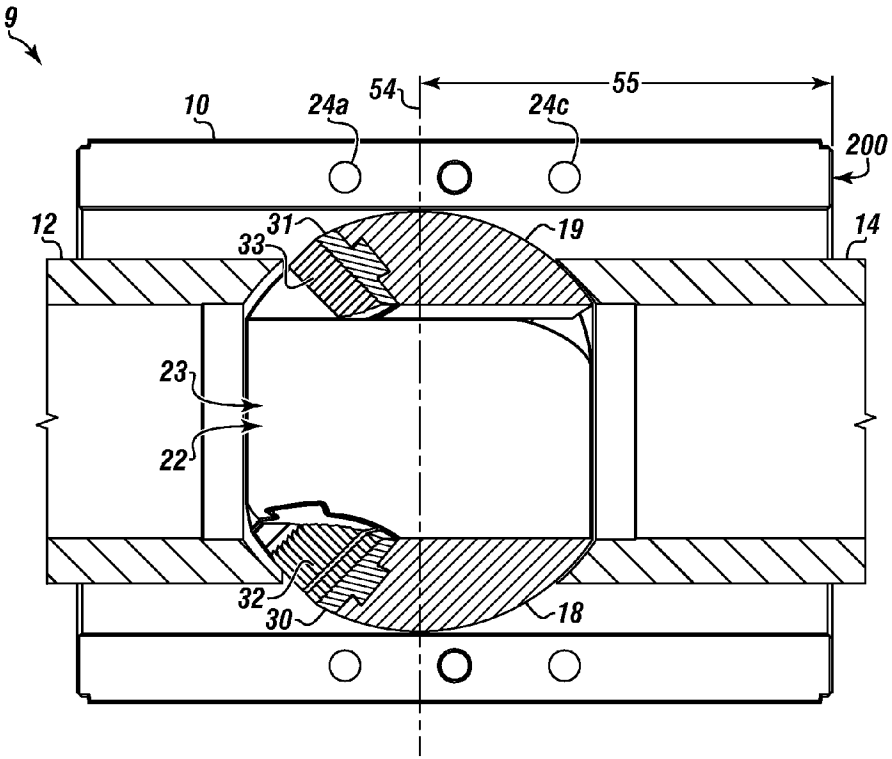
Figure 1B:
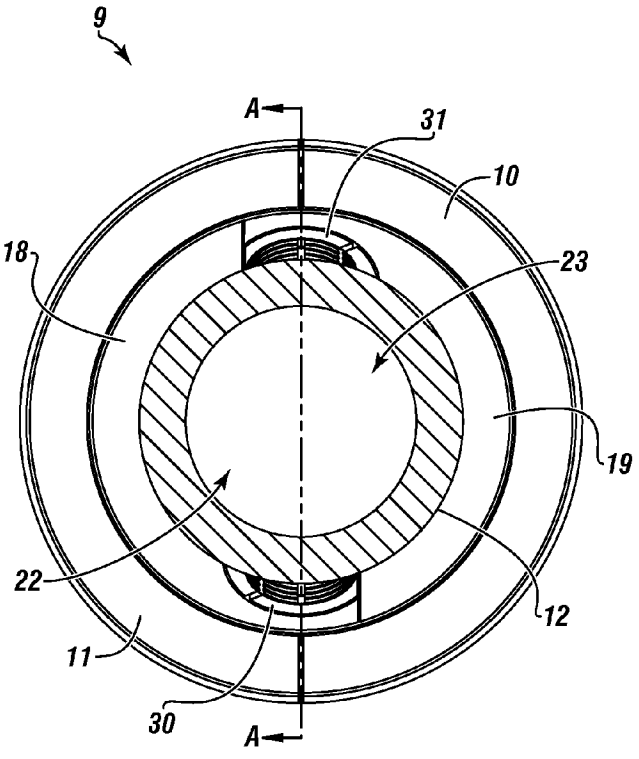

FIG. 1B depicts the gripper assembly 9 with the first half sleeve 10 engaging the second half sleeve 11 around the first gripper portion 18 facing a second gripper portion 19. In this embodiment, the first gripper portion 18 can rotate clockwise and the second gripper portion 19 can rotate counterclockwise.

The lower ball carrier 12 is also viewable along with a first channel 30 formed in the first gripper portion 18 and a second channel 31 formed in the second gripper portion 19.

Additionally, a first gripper portion bore 22 is shown opposing a second gripper portion bore 23.

FIG. 1C depicts a cross sectional view of the embodiment shown in FIG. 1B cut along line A-A.

The first half sleeve 10 with the fastener holes 24*a*-24*c* can have a sleeve end 200.

Within the first half sleeve 10 can be the first gripper portion 18 shown opposite the second gripper portion 19.

The first gripper portion 18 can have the first channel 30 with a first gripper face 32.

The second gripper portion 19 can have the second channel 31 with a second gripper face 33.

The first gripper portion 18 and the second gripper portion 19 can be positioned between the lower ball carrier 12 and the upper ball carrier 14.

In this open position for the gripper assembly 9, a first distance 55 from a centerline 54 to the sleeve end 200 is also depicted.

Figure 2A:
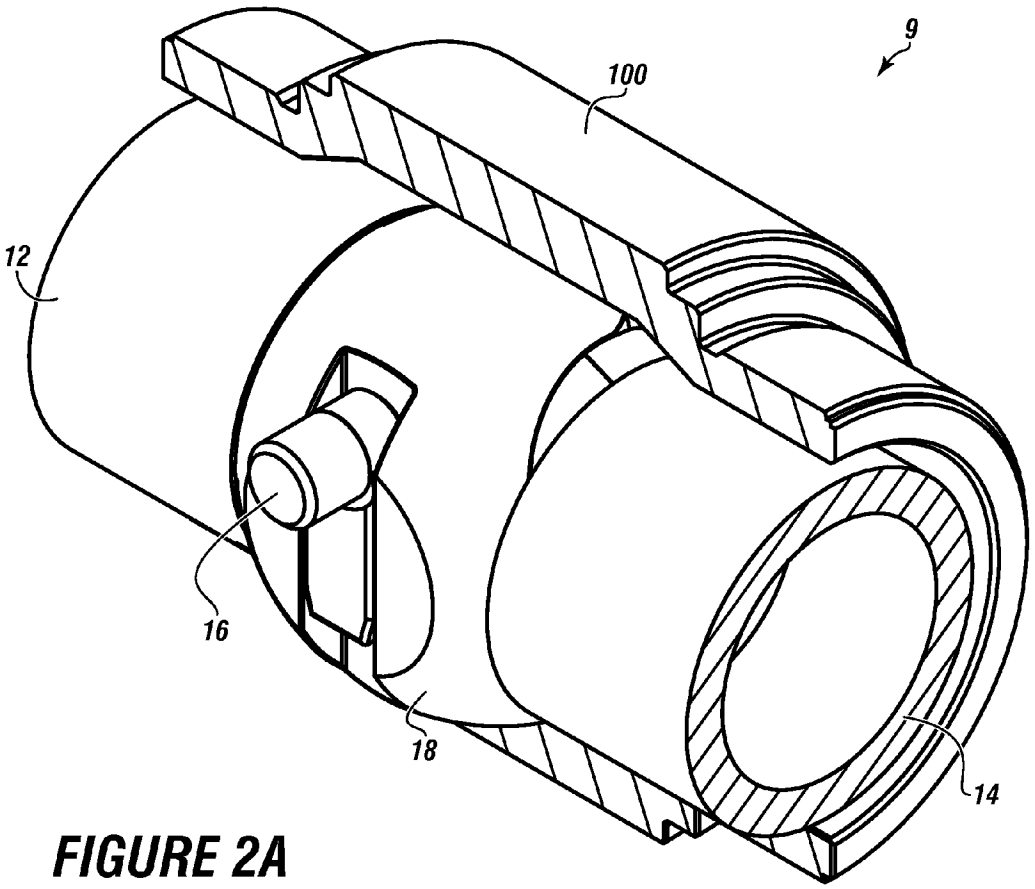
FIGS. 2A-2C depicts the gripper assembly in a mid-position or a partially closed position according to one or more embodiments.
Figure 2C:
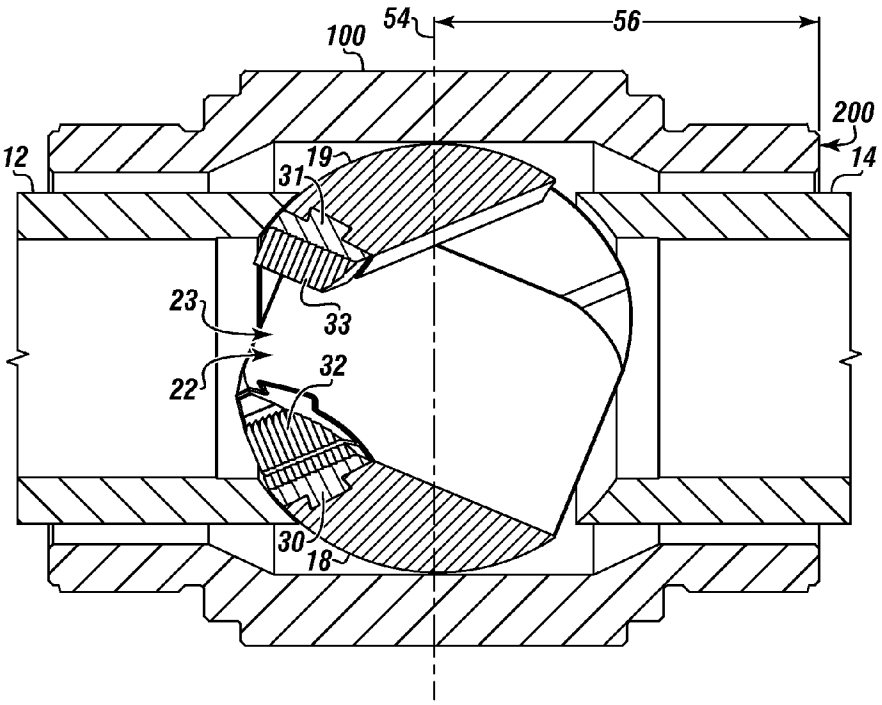
Figure 2B:
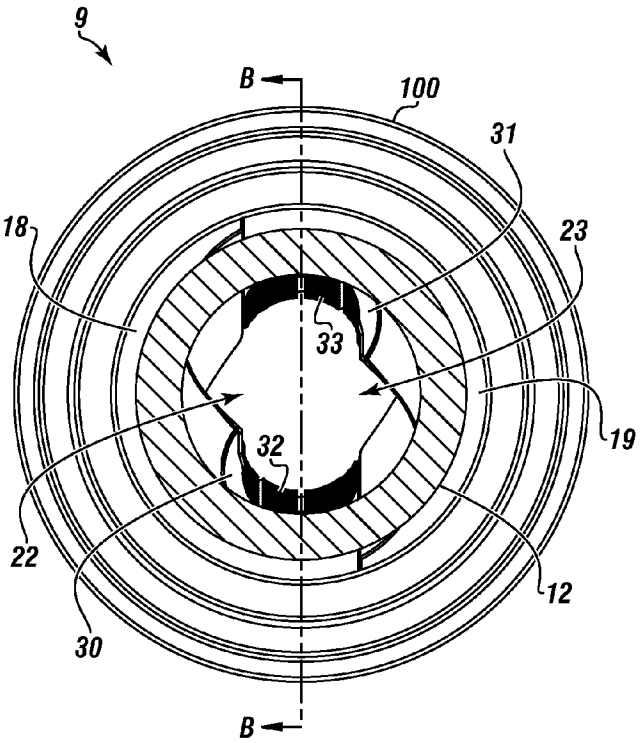

FIGS. 2A-2C depict a gripper assembly in a mid-position or a partially closed position according to one or more embodiments.

FIG. 2A depicts a gripper assembly 9 in an embodiment with a one piece operator sleeve 100.

No fastener holes and no fasteners are used in this embodiment of the one piece operator sleeve 100.

The lower ball carrier 12 and the upper ball carrier 14 can contain the first gripper portion 18 with the operator arm 16.

FIG. 2B depicts the one piece operator sleeve 100 around the first gripper portion 18 facing the second gripper portion 19. In this embodiment the first gripper portion 18 can rotate clockwise and the second gripper portion 19 can rotate counterclockwise.

The lower ball carrier 12 is also viewable in this Figure along with the first channel 30 formed in the first gripper portion.

The gripper assembly 9 can also have a second channel 31 formed in the second gripper portion 19.

The first channel 30 has a first gripper face 32 and the second channel 31 can have a second gripper face 33.

Additionally, the first gripper portion bore 22 can be opposing the second gripper portion bore 23.

The lower ball carrier 12 is also shown.

FIG. 2C depicts the one piece operator sleeve 100 in this cross sectional view of the embodiment shown in FIG. 2B cut along the B-B line.

The one piece operator sleeve 100 can have the sleeve end 200.

Within the one piece operator sleeve 100 can be the first gripper portion 18 shown opposite the second gripper portion 19.

The first gripper portion 18 can have the first channel 30 with the first gripper face 32.

The second gripper portion 19 can have the second channel 31 with the second gripper face 33.

The first gripper portion 18 and the second gripper portion 19 can be positioned between the lower ball carrier 12 and the upper ball carrier 14 and rotated to slightly close around the bore.

Also labelled are the first gripper portion bore 22 and the second gripper portion bore 23.

In this mid-position, a second distance 56 from the centerline 54 to the sleeve end 200 is also labelled.

This second distance 56 can be from 1 percent to 50 percent less than the first distance 55.

Figure 3A:
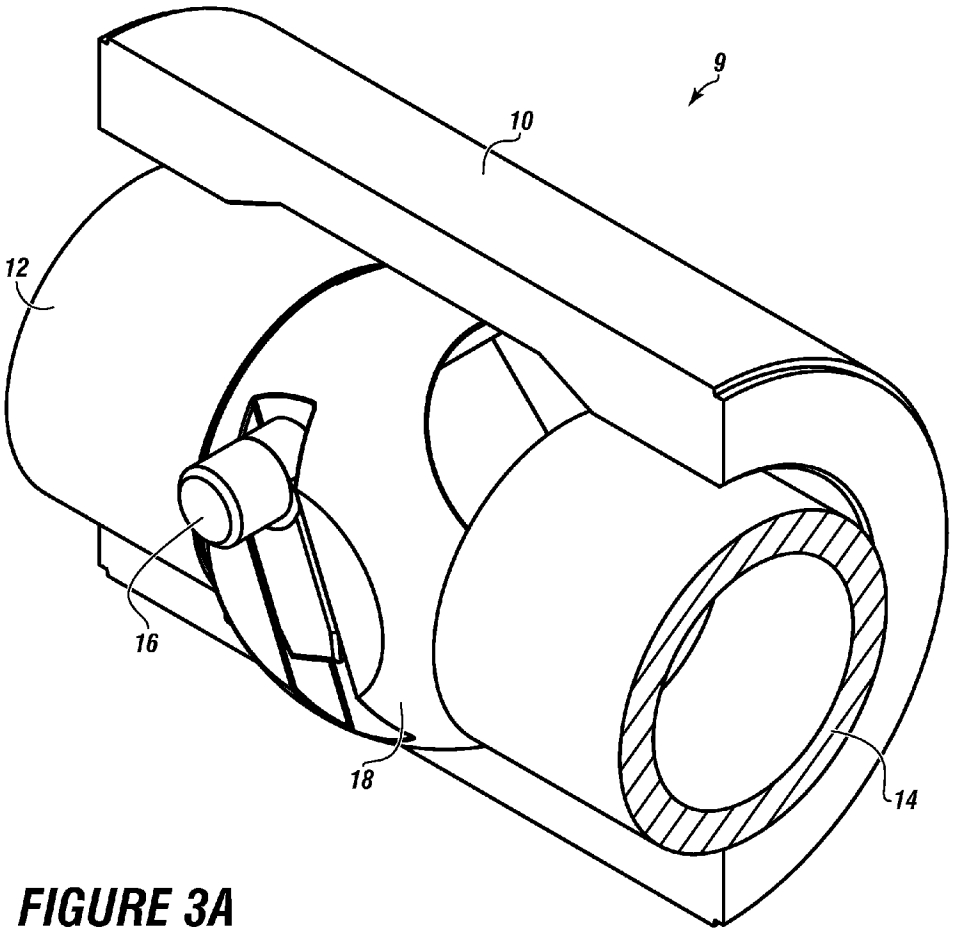
FIGS. 3A-3C depicts the gripper assembly as shown in FIGS. 1A-IC in a closed position for gripping an object according to one or more embodiments.
Figure 3C:
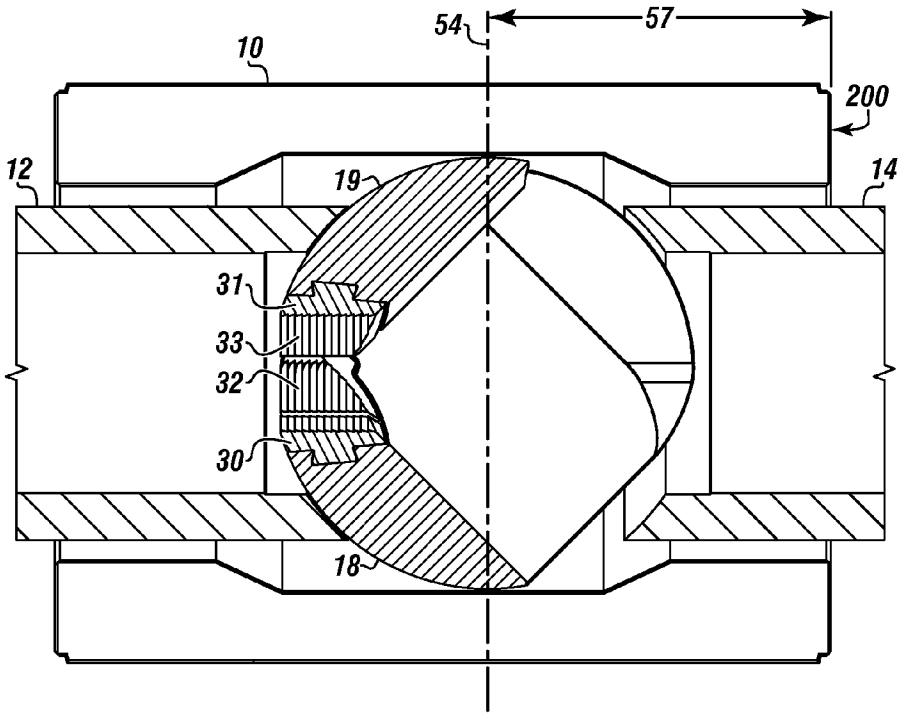
Figure 3B:
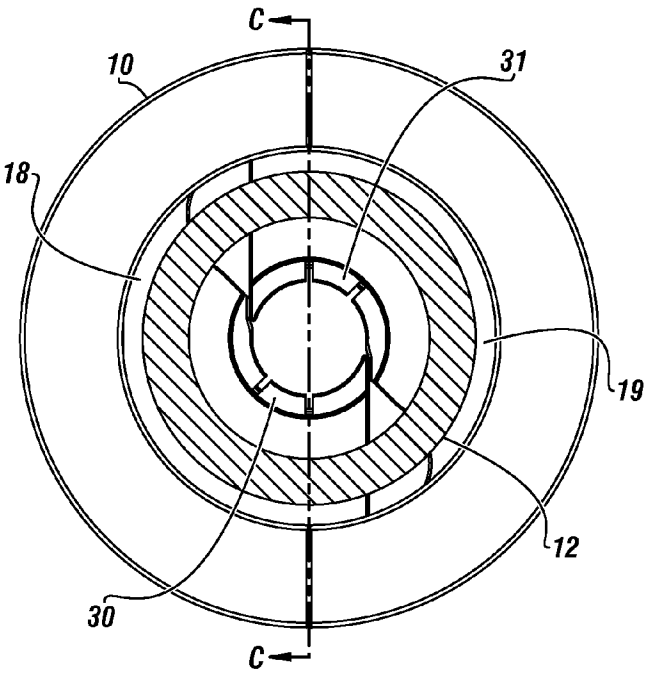

FIGS. 3A-3C depict a gripper assembly as shown in FIGS. 1A-IC in a closed position for gripping an object according to one or more embodiments.

FIG. 3A depicts a view of a gripper assembly 9 in a closed position.

This embodiment only operates in one direction and is not reversible.

The first half sleeve 10 can contain the upper ball carrier 14 and the lower ball carrier 12. Between the ball carriers can be seen the first gripper portion 18 and its associated operator arm 16.

FIG. 3B depicts the first half sleeve 10 engaging the second half sleeve.

The two connected sleeves surround the first gripper portion 18 facing the second gripper portion 19. In this embodiment the first gripper portion 18 can rotate clockwise and the second gripper portion 19 can rotate counterclockwise.

The lower ball carrier 12 is also viewable along with the first channel 30 formed in the first gripper portion 18.

The second channel 31 can be formed in the second gripper portion 19.

FIG. 3C depicts a cross sectional view of the embodiment shown in FIG. 3B cut along the C-C line.

The first half sleeve 10 can have the sleeve end 200.

Within the first half sleeve 10 can be the first gripper portion 18 shown opposite a second gripper portion 19.

The first gripper portion 18 can have the first channel 30 with the first gripper face 32.

The second gripper portion 19 can have the second channel 31 with the second gripper face 33.

The first gripper portion 18 and the second gripper portion 19 are shown positioned between the lower ball carrier 12 and the upper ball carrier 14.

In this closed position a third distance 57 from the centerline 54 to the sleeve end 200 is also labelled.

This third distance can be the smallest distance from the centerline 54 to the sleeve end 200 and can be from 1 percent to 50 percent less than the second distance.

Figure 4:
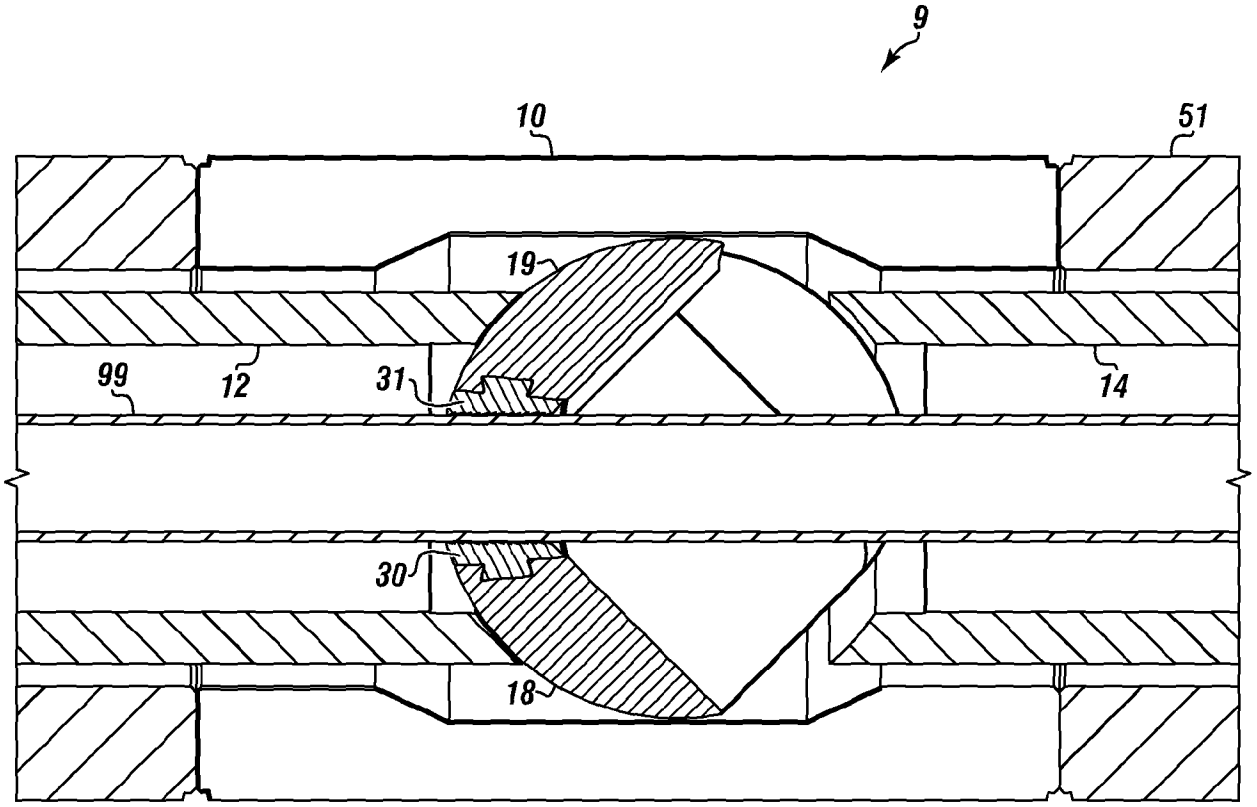
FIG. 4 depicts the gripper assembly connected to coiled tubing and a drill pipe according to one or more embodiments.

FIG. 4 depicts a gripper assembly 9 connected to coiled tubing and a drill pipe according to one or more embodiments.

A coiled tubing 99 can be contained through the first gripper portion 18 and the second gripper portion 19.

The lower ball carrier 12 and the upper ball carrier 14 can contain the first gripper portion 18 and the second gripper portion 19.

The ball carriers and gripper portions can be contained within a first half sleeve 10 that abuts or engages with a drill pipe 51.

The first channel 30 and the second channel 31 is also shown.

Figure 5B:
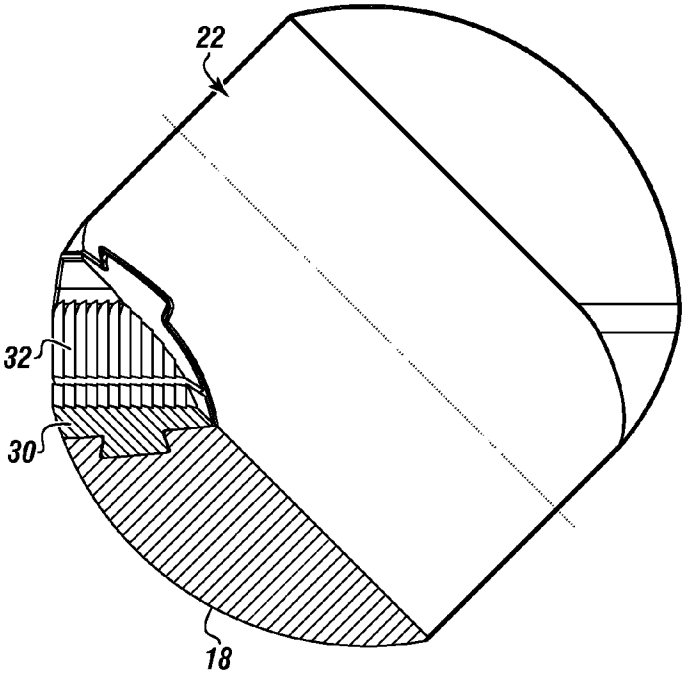
FIG. 5B depicts the first gripper portion of FIG. 5A shown along cut lines D-D according to one or more embodiments.
Figure 5A:
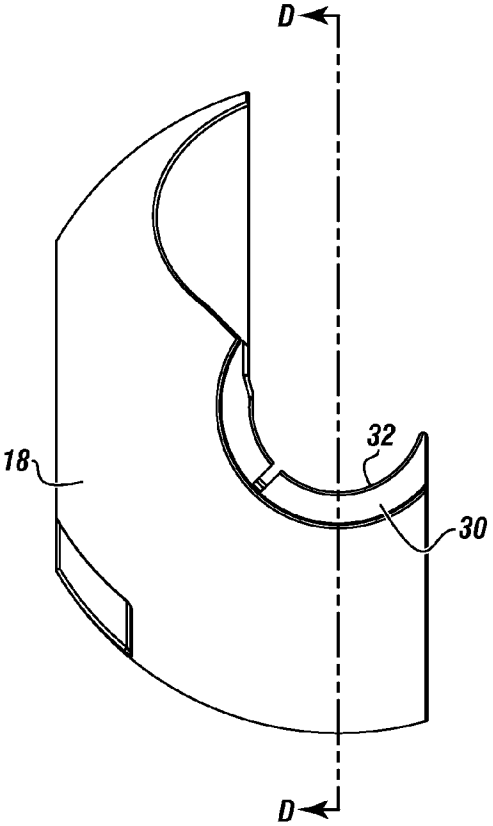
FIG. 5A depicts a first gripper portion according to one or more embodiments.

FIG. 5A depicts a first gripper portion according to one or more embodiments.

The first gripper portion 18 can have the first channel 30 with the first gripper face 32.

FIG. 5B depicts the first gripper portion of FIG. 5A shown along cut lines D-D according to one or more embodiments.

The first gripper portion bore 22 and the first channel 30 with the first gripper face 32.

The first gripper portion 18 is also shown.

In embodiments, each gripper face can clamp around coiled tubing threaded through the gripper portions.

In embodiments, the operator arm formed in one of the gripper portions can apply translational force to the gripper portions, moving the gripper portions in the operator sleeve toward the sleeve end.

The translational force can be provided by: a hydraulic piston, a pneumatic piston, an electromagnetic device, a plurality of explosive bolts, a propellant, and the like.

In embodiments, an open flow path for drilling fluid can be formed through the gripper assembly.

In embodiments, the gripper portions can be a partial spherical shape, a partial cylindrical shape, or a partial conical shape.

In embodiments, the gripper assembly can be configured to be located within a surface blowout preventer stack or a subsea blowout preventer stack.

In embodiments, the gripper assembly can be configured to be located within a wellbore.

In further embodiments, the gripper assembly can be configured to be located on top of a wellbore.

In further embodiments, the gripper assembly can be configured to be located below a coiled tubing cutting device.

In embodiments, the invention can include a method of suspending cut coiled tubing in a well bore.

The method can involve establishing a gripper assembly around coiled tubing to be cut.

An open flow path for drilling fluid can be formed through the gripper assembly.

Translational force can be applied to the gripper portions in a coiled tubing hanger assembly moving the gripper portions and ball carriers from an open position, enabling drilling flow, to a closed position around the coiled tubing. The gripper portions and ball carriers can grip the coiled tubing to be cut between a first channel and a second channel and can support the coiled tubing as the coiled tubing is cut above the gripper portion. The gripper assembly can keep the coiled tubing from falling to the bottom of the well bore.

While these embodiments have been described with emphasis on the embodiments, it should be understood that within the scope of the appended claims, the embodiments might be practiced other than as specifically described herein.

What is claimed is:

1. A gripper assembly for gripping an object within a constrained space comprising:

a. a first gripper portion comprising a first channel;

b. a second gripper portion proximate the first gripper portion comprising a second channel;

c. a means of constraining the first gripper portion and the second gripper portion at a desired orientation and position, wherein the means of constraining the first gripper portion and the second gripper portion comprises a one piece operator sleeve, a lower ball carrier, and an upper all carrier; and d. a means of rotating:

(i) the first gripper portion;

(ii) the second gripper portion; or (iii) the first gripper portion and the second gripper portion; and wherein the first channel and the second channel form a bore allowing the object to pass through the first gripper portion and the second gripper portion, and further wherein the bore constricts to grip the object upon rotation of the first gripper portion, the second gripper portion, or both the first gripper portion and the second gripper portion.

2. The gripper assembly of claim 1, wherein the first gripper portion and the second gripper portion are:

a. substantially spherical;

b. substantially cylindrical; or c. substantially conical.

3. The gripper assembly of claim 1, wherein the first channel and the second channel each have a gripper face for gripping the object.

4. The gripper assembly of claim 1, wherein the means of constraining the first gripper portion and the second gripper portion is:

a. a housing;

b. a sleeve;

c. a frame;

d. a guide arm; or e. a geometry of the constrained space.

5. The gripper assembly of claim 1, wherein the one piece operator sleeve comprises a first half with fastener holes and a second half with the fastener holes enabling the first half of the one piece operator sleeve and the second half of the one piece operator sleeve to be connected together around the first gripper portion and the second gripper portion.

6. The gripper assembly of claim 1, wherein the means of rotating the first gripper portion, the means of rotating the second gripper portion, or the means of rotating the first gripper portion and the second gripper portion comprise an operator arm to apply translational force, moving the first gripper portion and the second gripper portion within an one piece operator sleeve.

7. The gripper assembly of claim 6, wherein the translational force is provided by at least one of:

a. a hydraulic piston;

b. a pneumatic piston;

c. an electromagnetic device;

d. an explosive bolt; and e. a propellant.

8. The gripper assembly of claim 1, wherein the gripper assembly is configured to be located within a surface blowout preventer stack or a subsea blowout preventer stack.

9. The gripper assembly of claim 1, wherein the gripper assembly is configured to be located within a wellbore.

10. The gripper assembly of claim 1, wherein the gripper assembly is configured to be located on top of a wellbore.

11. The gripper assembly of claim 1, wherein the gripper assembly is configured to be located below a coiled tubing cutting device.

12. The gripper assembly of claim 1, wherein the object is a wireline.

13. A method of suspending cut coiled tubing in a wellbore, the method comprising:

a. establishing a gripper assembly around the coiled tubing to be cut;

b. forming an open flow path for drilling fluid through the gripper assembly;

c. applying translational force to the gripper assembly moving the gripper assembly to a closed position around the coiled tubing; and d. gripping the coiled tubing to be cut with the gripper assembly and supporting the coiled tubing as the coiled tubing is cut above the gripper assembly, thereby keeping the coiled tubing from falling to the bottom of the wellbore;

wherein the gripping assembly comprises a means of constraining the plurality of gripper portions at a desired orientation and position, wherein the means of constraining the plurality of gripper portions comprises a one piece operator sleeve, a lower ball carrier, and an upper ball carrier.

14. A gripper assembly for gripping an object within a constrained space comprising:

a. a plurality of gripper portions, each gripper portion of the plurality of gripper portions comprises a channel, wherein at least one gripper portion of the plurality of gripper portions is configured to rotate relative to at least one additional gripper portion of the plurality of gripper portions;

b. a means of constraining the plurality of gripper portions at a desired orientation and position, wherein the means of constraining the plurality of gripper portions comprises a one piece operator sleeve, a lower ball carrier, and an upper ball carrier; and c. a means of rotating the at least one gripper portion of the plurality of gripper portions; and wherein each gripper portion of the plurality of gripper portions orient the channel to form a bore allowing the object to pass through the gripper assembly, and further wherein the bore constricts to grip the object upon rotation of the at least one gripper portion of the plurality of gripper portions.

* * * * *